US006228138B1

(12) United States Patent
Yamanishi et al.

(10) Patent No.: US 6,228,138 B1
(45) Date of Patent: May 8, 2001

(54) GOOD MACHINABILITY FE-BASED SINTERED ALLOY AND PROCESS OF MANUFACTURE THEREFOR

(75) Inventors: Yuuji Yamanishi; Tadayuki Tsutsui, both of Matsudo; Kei Ishii, Shonan-machi, all of (JP)

(73) Assignee: Hitachi Powdered Metals Co., Ltd., Chiba (JP)

( * ) Notice: Subject to any disclaimer, the term of this patent is extended or adjusted under 35 U.S.C. 154(b) by 0 days.

(21) Appl. No.: 09/434,577

(22) Filed: Nov. 4, 1999

(30) Foreign Application Priority Data

Nov. 17, 1998 (JP) ..... 10-326580

(51) Int. Cl.[7] ..... C22C 33/02; C22C 38/02

(52) U.S. Cl. ..... 75/231; 75/246; 419/11; 419/13; 419/34

(58) Field of Search ..... 75/246, 230, 243, 75/231; 419/34, 11, 13

(56) References Cited

U.S. PATENT DOCUMENTS 3,982,905 * 9/1976 Osawa et al. ..... 29/182.5
4,032,336 * 6/1977 Reen ..... 75/224
4,311,524 * 1/1982 Genkin et al. ..... 75/231
4,552,590 * 11/1985 Nakata et al. ..... 75/246
4,561,889 * 12/1985 Oaku et al. ..... 75/125
4,849,164 * 7/1989 Jandeska et al. ..... 419/11
4,943,321 7/1990 Akutsu ..... 75/243
5,338,508 * 8/1994 Nitta et al. ..... 420/120
5,819,154 * 10/1998 Hu et al. ..... 419/11
5,938,814 * 8/1999 Uenoson et al. ..... 75/254
5,967,110 * 10/1999 Tsutsui et al. ..... 123/195 HC

FOREIGN PATENT DOCUMENTS 1428584 3/1976 (GB) .
2307917 6/1997 (GB) .
2324537 10/1998 (GB) .

* cited by examiner

*Primary Examiner*—Daniel Jenkins
(74) *Attorney, Agent, or Firm*—Scully, Scott, Murphy & Presser

(57) ABSTRACT

Machinability is drastically improved while maintaining some degree of hardness in an Fe-based sintered alloy. A good machinability Fe-based sintered alloy has an overall composition of, in percent by weight, at least one element selected from the group consisting of P in an amount of 0.1 to 1.0% and Si in an amount of 2.0 to 3.0%, B in an amount of 0.003 to 0.31%, 0 in an amount of 0.007 to 0.69%, C in an amount of 0.1 to 2.0%, and the balance consisting of Fe and unavoidable impurities, has a matrix hardness ranging from Hv 150 to 250, and has free graphite dispersed therein.

7 Claims, 6 Drawing Sheets

GOOD MACHINABILITY FE-BASED SINTERED ALLOY AND PROCESS OF MANUFACTURE THEREFOR

BACKGROUND OF THE INVENTION

The present invention relates to a good machinability Fe-based sintered alloy and a process of manufacture therefor, and more particularly relates to a technique which can improve machinability by sintering a boron compound powder added to a mixed powder of an Fe-based material.

An Fe-based sintered alloy can be produced in near-net shape so that manufacturing cost for processing can be reduced, and moreover, elements may be dispersed therein having specific gravities which differ greatly, and in different alloys in which dissolution is difficult, whereby properties may be obtained such as wear resistance, etc. For this reason, Fe-based sintered alloys are often used in various fields of technology. For example, mechanical parts made of Fe-based sintered alloy can be made without considerable machining processing, even if the parts are of complicated configuration, whereby such parts can be widely employed in valve driving systems, bearings, and the like, in automobiles, motorcycles, etc. However, most mechanical parts made of Fe-based sintered alloys must be machined, therefore poor machinability still present problems.

In order to improve the machinability of Fe-based sintered alloys, many attempts have heretofore been made. In one attempt, an Fe powder containing sulfur is used as a starting material powder. In another attempt, sulfide is added to and mixed with a starting material powder. In still another attempt, a sintered compact is sulfurized in an atmosphere of hydrogen sulfide gas. However, when sulfur as a cutting facilitating component is dispersed in the matrix of a sintered alloy, improvement in machinability is limited. Moreover, sulfur is an element which decreases strength, particularly toughness, in sintered alloys, and also promotes corrosion in sintered alloys; therefore, use of such sintered alloys is limited.

Another technique which fills resin, etc., into pores of a sintered alloy is also available. In such a sintered alloy, the resin in the pore serves as an initiating point for chip breaking, whereby the chip-breaking property is superior. However, in such a technique, using certain types of resin may shorten the service life of a cutting tool such as a cutter. Moreover, a process for removing the resin from the pores after cutting processing may be required, depending on the purpose for which the sintered alloy is to be used.

Therefore, the present applicant proposed an improved method for an Fe-based sintered alloy, in which a boron compound powder is added to a mixed powder of an Fe-based material including carbon, and is sintered, in Japanese Unexamined Patent Application Publication No. 241701/97. According to this proposed technique, diffusion of the carbon into the matrix is suppressed by the boron, whereby machinability can be improved with a decrease in hardness of the Fe-based sintered alloy.

However, further improvement of machinability has been recently demanded to enhance high performance alloys for automobiles.

SUMMARY OF THE INVENTION

It is therefore an object of the present invention to provide a good machinability Fe-based sintered alloy which is further improved over the above Fe-based sintered alloy and a process of manufacture therefor. Generally, it is known that such materials harden when the carbon content of an Fe-based sintered part is increased, and that machinability thereof is lowered thereby. However, according to research by the inventors, the following knowledge was obtained. In the case in which the matrix of the Fe-based sintered portion closely resembles pure iron and the hardness thereof is too low, the amount of wear on a cutting tool conversely increases.

FIG. 1 is a chart showing the amount of wear on a cutting tool in cutting processing with respect to 4 kinds of Fe-1.5Cu—C-based sintered parts (A–D) having different hardnesses, which are produced by changing the C content, and an Fe-1.5Cu—C-based sintered part (E), which has improved machinability by a technique disclosed in the above-mentioned Japanese Unexamined Patent Application Publication No. 157706/97.

Hitherto, it was expected that machinability of a part A having the lowest hardness would be most desirable and that the amount of tool wear thereof would be minimal. However, as is apparent from FIG. 1, the softest part A in which hardness of a surface thereof ranges from Hv 110 to 120 (load=100 gf) actually has the highest amount of wear, and a part C in which the hardness ranges from Hv 200 to 230 has the least amount of wear. It is apparent that the amount of wear on the cutting tool is drastically reduced in comparison with the amount of wear on the part A, in the case in which hardnesses range from Hv 150 to 250. As a reason for this, it is believed that adhesive wear is generated on an edge of the cutting tool during cutting processing since ferrite, which is a matrix of the Fe-based sintered portion, has high viscosity.

As shown in FIG. 1, an Fe-based sintered alloy having improved machinability by a technique shown in the Japanese Unexamined Patent Application Publication No. 157706/97 has the smallest amount of wear, and remarkable improvement in machinability appears. Moreover, it is believed that machinability can be further improved by increasing matrix hardness and suppressing generation of adhesive wear.

Therefore, the inventors found that the amount of wear on a cutting tool is remarkably reduced when hardness is increased by alloying ferrite and is set within a specific range.

In consideration of this situation, a good machinability Fe-based sintered alloy of this invention has an overall composition consisting of, in percent by weight, at least one element selected from the group consisting of P in the amount of 0.1 to 1.0% and Si in the amount of 2.0 to 3.0%, B in the amount of 0.003 to 0.31%, O in the amount of 0.007 to 0.69%, C in the amount of 0.1 to 2.0%, and the balance consisting of Fe and unavoidable impurities, has a matrix hardness ranging from Hv 150 to 250, and has free graphite dispersed therein. Here, the Hv refers to a Vickers hardness at a load of 100 gf.

In this invention, free graphite is dispersed and functions as a solid lubricant, whereby machinability is improved. Boron is contained at 0.003% by weight or more in the Fe-based sintered alloy, whereby the boron prevents graphite from diffusing as C so as to ensure that the graphite remains free and prevents pearite from forming in the matrix. According to the research of the inventors, reasons for the improved machinability due to the boron are as follows.

That is to say, boron compound powder (for example, boron oxide ($B_2O_3$)), added to a powder mixture, dissolves at about 500° C., which is lower than the temperature at which C diffuses into the matrix during heating for sintering, and covers the surfaces of the graphite powder. The C of the graphite powder does not diffuse into the ferrite matrix and cannot form pearite, and remains as free graphite, and the machinability thereof is remarkably improved by functioning as a solid lubricant. In this invention, matrix hardness is particularly set as described above by containing P and Si, whereby further improvement in machinability is achieved.

P: Action of ferrite strengthening is slight when the P content is under 0.1% by weight. As a result, a hard matrix is not obtained, thereby failing to improve machinability. In contrast, when the P content exceeds 1.0% by weight, the generation rate of the Fe—P liquid phase increases in sintering, whereby a green compact easily loses its shape during sintering. Therefore, the P content ranges preferably from 0.1 to 1.0% by weight. Moreover, the P can be added in the form of a simple powder; however, it is preferably added in the form of an Fe—P alloy powder since the simple powder is dangerous.

Si: Si can be added in the form of a simple powder so that it quickly diffuses in the matrix; however, pure Si is expensive, and it is therefore preferably added in the economical form of an Fe—Si alloy powder in consideration of industrial productivity. Ferrite strengthening effects are slight when the Si content is under 2.0% by weight. As a result, a hard matrix is not obtained, thereby failing to improve machinability. In contrast, when the Si content exceeds 3.0% by weight, the Fe—P sintered powder hardens, decreasing compressibility thereof during sintering. As a result, the required density in the sintered compact cannot be obtained, and the strength thereof is lowered. Therefore, the Si content preferably ranges from 2.0 to 3.0% by weight.

C: C is added in the form of a graphite powder. However, the amount of carbon diffused in the matrix is too small when the amount added (i.e., the C content) is less than 0.1% by weight, and the desired strength is not obtained, and additionally, the amount of undiffused free graphite is small, whereby machinability is not improved. In contrast, when the C content is too high and diffusion cannot be suppressed, i.e., when the addition amount of the graphite powder exceeds 2.0% by weight, pearite is thereby formed.

B and O: B and O are mainly contained by being added in the form of a boron oxide powder. B in the amount of 0.003 to 0.31% by weight and O in the amount of 0.007 to 0.69% by weight correspond to $B_2O_3$ in the amount of 0.01 to 1.0% by weight. Diffusion of C from graphite powder cannot be suppressed in sintering when the content of each is less than the lower limit, respectively. In contrast, when the upper limit is exceeded, not only does the effect of suppression of diffusion of C not occur, but also a large amount of boron oxide remains in the matrix, whereby material strength is lowered.

Moreover, by containing Cu in the material of this invention, the strength thereof can be improved while maintaining machinability. In this case, the Cu content preferably ranges from 1.0 to 5.0% by weight. The Cu also strengthens the material by diffusing in the matrix, but the effect thereof is slight below 1.0% by weight. In contrast, when the Cu content exceeds 5.0% by weight, the strength is lowered by the generating of a soft Cu phase. Dimensional contraction caused by generating the Cu liquid phase during sintering and the Cu expansion phenomenon caused by the Cu which is easily diffused in the Fe matrix by generating the liquid phase, are caused by microscopic contractions and expansions in each local area of the product. As a result, dimensional changes of the overall product vary widely, whereby dimensional accuracy is poor. Moreover, the Cu powder is added in the form of a simple powder, and average particle size of the Cu powder and the graphite powder range from 1 to 10 $\mu$m, which is the range usually used.

In the above-described good machinability Fe-based sintered alloy, the machinability can be further improved by dispersing BN in an amount of 0.06 to 2.25% by weight in the matrix. The BN has chip breaking effects and solid lubrication effects, thereby improving machinability. The above effects are slight when the BN content is under 0.06% by weight, and the strength of the matrix is lowered when the content exceeds 2.25% by weight.

A good machinability Fe-based sintered alloy such as that described above can be produced by adding, in percent by weight of the total mixed powder, an Fe-based powder consisting of at least one element selected from the group consisting of P in the amount of 0.1 to 1.0% and Si in the amount of 2.0 to 3.0%, the balance consisting of Fe and unavoidable impurities, a graphite powder in the amount of 0.1 to 2.0%, and a boron oxide powder in the amount of 0.001 to 1.0%. The boron oxide powder is added at 0.1% by weight or more. In the case in which the boron oxide powder content is less than the above, diffusion of C from the graphite powder cannot be suppressed in sintering, whereby pearite is formed. In contrast, even if the boron oxide powder is added at 1.0% by weight or more, not only can the suppression effects on the diffusion of C not be expected to improve, but also a large amount of the boron oxide remains in the matrix, and the strength of the material is lowered.

As an addition method for boron oxide, a method for adding the boron oxide in the form of a simple powder or a method for adding boron nitride can be employed. BN can be dispersed in the matrix by adding the boron nitride. Available powders of boron nitride contain boron oxide as a residue from a production process. The available powder of boron nitride in which the boron oxide is reduced to 5% by weight or less is used in powder metallurgy. However, this available powder of boron nitride is expensive since purity is high. Therefore, according to the research of the inventors with regard to the boron oxide content included in the boron nitride powder, the available powder of boron nitride in which the boron oxide content is 10 to 40% by weight is relatively inexpensive, and it was found that diffusion of graphite is suppressed by adding this powder in amount of 0.1 to 2.5% by weight, instead of the boron oxide powder, whereby generation of pearite is suppressed.

According to this invention, workability and tool life can be improved when applied to bearing caps for automobile engines, synchronizer hubs, various gears for general-purpose engines, alloys for office equipment, and alloys for machine tools, etc., in which cutting processes are conducted on surfaces of a sintered alloy and for the sizing thereof.

DETAILED DESCRIPTION OF THE PREFERRED EMBODIMENTS

Figure 1:
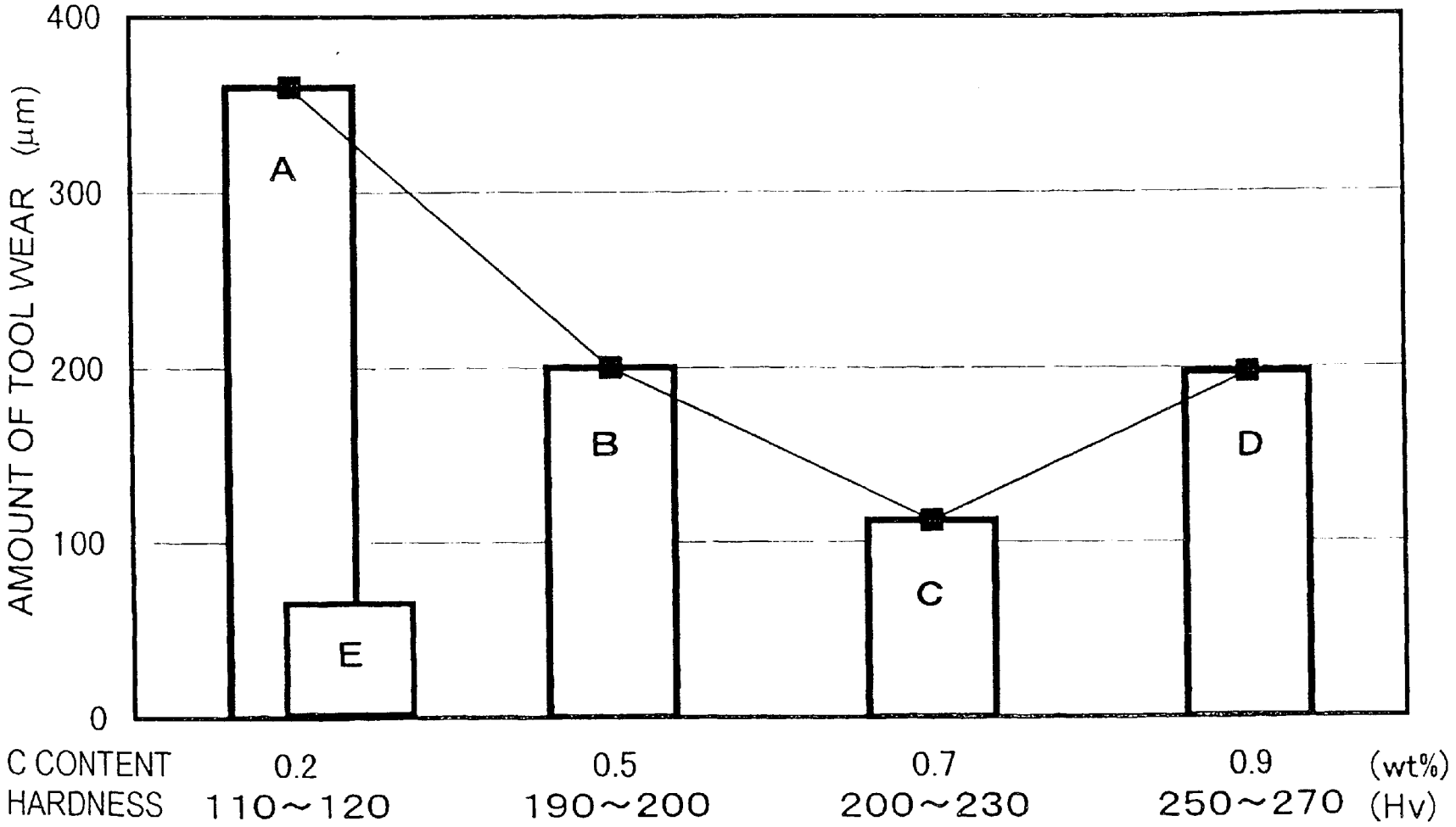
FIG. 1 is a chart showing the relationship between the matrix hardness and the amount of tool wear.

In the following, preferred embodiments according to the present invention will be described in detail.

A. Manufacture of Sintered Compacts

Raw material powders were prepared at compounding ratios shown in Table 1 and were mixed by a V type mixer for 30 minutes. The mixed powders were molded at a density of 6.6 g/cm$^3$ in powder compacting, and five green compacts having outer diameters of 32 mm, inner diameters of 15 mm, and heights of 10 mm were produced for each mixed powder. Then, each green compact was sintered by heating at 1130° C. for 60 minutes in a reducing atmosphere (dissociated ammonia gas).

TABLE 1

| Sample | Mixing Ratio wt % | | | | | | | Overall Constituent Composition wt % | | | | | | | | Evaluated Item | | |
|---|---|---|---|---|---|---|---|---|---|---|---|---|---|---|---|---|---|---|
| | | | | | | | | | | | | | | | | Matrix Hardness | Tool Wear Amount | |
| No. | Fe Powder | Cu Powder | Fe-20P Powder | Fe-40P Powder | Graphite Powder | Boron Oxide Powder | Boron Nitride Powder | Fe | Cu | P | Si | C | B | O | BN | (Hv) | (μm) | Note |
| 1 | Balance | 1.5 | — | — | 0.6 | — | 1.0 | Balance | 1.5 | — | — | 0.6 | 0.062 | 0.138 | 0.80 | 121 | 80 | Substantial Tool Wear |
| 2 | Balance | 1.5 | 0.25 | — | 0.6 | — | 1.0 | Balance | 1.5 | 0.05 | — | 0.6 | 0.062 | 0.138 | 0.80 | 151 | 71 | |
| 3 | Balance | 1.5 | 1.00 | — | 0.6 | — | 1.0 | Balance | 1.5 | 0.10 | — | 0.6 | 0.062 | 0.138 | 0.80 | 170 | 45 | |
| 4 | Balance | 1.5 | 2.50 | — | 0.6 | — | 1.0 | Balance | 1.5 | 0.50 | — | 0.6 | 0.062 | 0.138 | 0.80 | 211 | 33 | |
| 5 | Balance | 1.5 | 5.00 | — | 0.6 | — | 1.0 | Balance | 1.5 | 1.00 | — | 0.6 | 0.062 | 0.138 | 0.80 | 243 | 32 | |
| 6 | Balance | 1.5 | 5.50 | — | 0.6 | — | 1.0 | Balance | 1.5 | 1.10 | — | 0.6 | 0.062 | 0.138 | 0.80 | — | — | Loss of Shape |
| 7 | Balance | 1.5 | — | 2.50 | 0.6 | — | 1.0 | Balance | 1.5 | — | 1.00 | 0.6 | 0.062 | 0.138 | 0.80 | 141 | 68 | Substantial Tool Wear |
| 8 | Balance | 1.5 | — | 5.00 | 0.6 | — | 1.0 | Balance | 1.5 | — | 2.00 | 0.6 | 0.062 | 0.138 | 0.80 | 207 | 36 | |
| 9 | Balance | 1.5 | — | 7.50 | 0.6 | — | 1.0 | Balance | 1.5 | — | 3.00 | 0.6 | 0.062 | 0.138 | 0.80 | 232 | 34 | |
| 10 | Balance | 1.5 | — | 10.00 | 0.6 | — | 1.0 | Balance | 1.5 | — | 4.00 | 0.6 | 0.062 | 0.138 | 0.80 | 259 | 42 | Less Compressible |
| 11 | Balance | 1.5 | 2.50 | 5.00 | 0.6 | — | 1.0 | Balance | 1.5 | 0.50 | 2.00 | 0.6 | 0.062 | 0.138 | 0.80 | 220 | 41 | |
| 12 | Balance | 1.5 | 2.50 | — | 0.6 | — | — | Balance | 1.5 | 0.50 | — | 0.6 | — | — | — | 353 | 85 | Substantial Tool Wear |
| 13 | Balance | 1.5 | 2.50 | — | 0.6 | 0.01 | — | Balance | 1.5 | 0.50 | — | 0.6 | 0.003 | 0.007 | — | 248 | 50 | |
| 14 | Balance | 1.5 | 2.50 | — | 0.6 | 0.20 | — | Balance | 1.5 | 0.50 | — | 0.6 | 0.062 | 0.138 | — | 200 | 35 | |
| 15 | Balance | 1.5 | 2.50 | — | 0.6 | 0.50 | — | Balance | 1.5 | 0.50 | — | 0.6 | 0.155 | 0.345 | — | 206 | 34 | |
| 16 | Balance | 1.5 | 2.50 | — | 0.6 | 1.00 | — | Balance | 1.5 | 0.50 | — | 0.6 | 0.311 | 0.689 | — | 198 | 34 | |
| 17 | Balance | 1.5 | 2.50 | — | 0.6 | 1.10 | — | Balance | 1.5 | 0.50 | — | 0.6 | 0.342 | 0.758 | — | 185 | 35 | Strength Degradation |
| 18 | Balance | — | 2.50 | — | 0.6 | 0.50 | — | Balance | — | 0.50 | — | 0.6 | 0.155 | 0.345 | — | 180 | 40 | |
| 19 | Balance | 1.0 | 2.50 | — | 0.6 | 0.50 | — | Balance | 1.0 | 0.50 | — | 0.6 | 0.155 | 0.345 | — | 187 | 41 | |
| 20 | Balance | 3.0 | 2.50 | — | 0.6 | 0.50 | — | Balance | 3.0 | 0.50 | — | 0.6 | 0.155 | 0.345 | — | 192 | 41 | |
| 21 | Balance | 5.0 | 2.50 | — | 0.6 | 0.50 | — | Balance | 5.0 | 0.50 | — | 0.6 | 0.155 | 0.345 | — | 212 | 40 | |
| 22 | Balance | 6.0 | 2.50 | — | 0.6 | 0.50 | — | Balance | 6.0 | 0.50 | — | 0.6 | 0.155 | 0.345 | — | 213 | 45 | Less Dimensional Accuracy |
| 23 | Balance | — | 2.50 | — | — | 0.50 | — | Balance | — | 0.50 | — | — | 0.155 | 0.345 | — | 178 | 120 | Substantial Tool Wear |
| 24 | Balance | — | 2.50 | — | 0.1 | 0.50 | — | Balance | — | 0.50 | — | 0.1 | 0.155 | 0.345 | — | 181 | 80 | |
| 25 | Balance | — | 2.50 | — | 1.0 | 0.50 | — | Balance | — | 0.50 | — | 1.0 | 0.155 | 0.345 | — | 192 | 40 | |
| 26 | Balance | — | 2.50 | — | 1.5 | 0.50 | — | Balance | — | 0.50 | — | 1.5 | 0.155 | 0.345 | — | 220 | 41 | |
| 27 | Balance | — | 2.50 | — | 2.0 | 0.50 | — | Balance | — | 0.50 | — | 2.0 | 0.155 | 0.345 | — | 249 | 49 | |
| 28 | Balance | — | 2.50 | — | 2.2 | 0.50 | — | Balance | — | 0.50 | — | 2.2 | 0.155 | 0.345 | — | 260 | 82 | Substantial Tool Wear |

B. Cutting Test

A cutting test was conducted on each sintered compact, and the flank wear width at a tool edge was evaluated as the amount of tool wear. The cutting test was performed by cutting over a distance of 7000 m using water- soluble cutting oil and an NC lathe which provides slow chipping away of cubic boron nitride (CBN) at a cutting speed of 180 mm/min, a feed rate of 0.04 mm/rev, and a cutting depth of 0.15 mm. Then, the sintered compact was polished and the micro-Vickers hardness was measured at random points, and the mean values thereof are listed in Table 1 with the amount of tool wear.

C. Evaluation

① Effect of P Content

Figure 2:
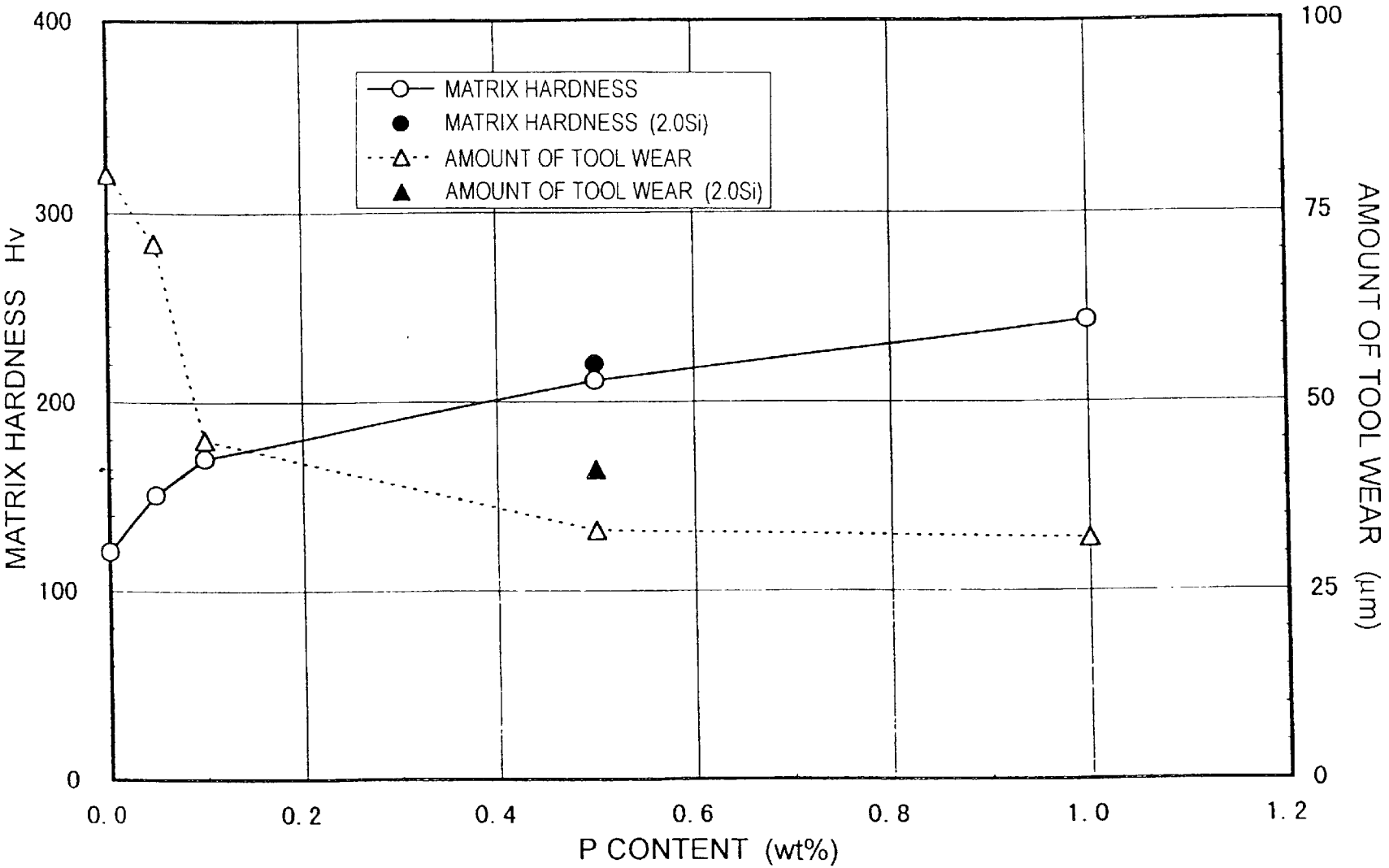
FIG. 2 is a chart showing the relationship between the P content, the matrix hardness, and the amount of tool wear.

Samples of differing P content were selected from Table 1 and are described in Table 2. The P content, matrix hardness, and amount of tool wear described in Table 2 are shown in FIG. 2. As is apparent from FIG. 2, the matrix hardness greatly increases until the P content increases to 0.1% by weight and the matrix hardness increases with the increase in the P content thereafter. In contrast, the amount of tool wear rapidly decreases until the P content increases to 0.1% by weight. In addition, in sample No. 6 in which the P content exceeds 1.0% by weight, many Fe—P liquid phases were generated during sintering, whereby the shape of the green compact was lost, and a sintered compact could not be formed. Therefore, the reason for the numerical limitation according to this invention in which the P content ranges from 0.1 to 1.0% by weight was confirmed.

TABLE 2

| Sample | Mixing Ratio wt % | | | | | | | Overall Constituent Composition wt % | | | | | | | | Evaluated Item | | |
|---|---|---|---|---|---|---|---|---|---|---|---|---|---|---|---|---|---|---|
| | | | | | | | | | | | | | | | | | Tool | |
| | Fe | Cu | Fe-20P | Fe-40P | Graphite | Boron Oxide | Boron Nitride | | | | | | | | | Matrix Hardness | Wear Amount | |
| No. | Powder | Powder | Powder | Powder | Powder | Powder | Powder | Fe | Cu | P | Si | C | B | O | BN | (Hv) | (μm) | Note |
| Effect of P content | | | | | | | | | | | | | | | | | | |
| 1 | Balance | 1.5 | — | — | 0.6 | — | 1.0 | Balance | 1.5 | — | — | 0.6 | 0.062 | 0.138 | 0.80 | 121 | 80 | Substantial Tool Wear |
| 2 | Balance | 1.5 | 0.25 | — | 0.6 | — | 1.0 | Balance | 1.5 | 0.05 | — | 0.6 | 0.062 | 0.138 | 0.80 | 151 | 71 | |
| 3 | Balance | 1.5 | 1.00 | — | 0.6 | — | 1.0 | Balance | 1.5 | 0.10 | — | 0.6 | 0.062 | 0.138 | 0.80 | 170 | 45 | |
| 4 | Balance | 1.5 | 2.50 | — | 0.6 | — | 1.0 | Balance | 1.5 | 0.50 | — | 0.6 | 0.062 | 0.138 | 0.80 | 211 | 33 | |
| 5 | Balance | 1.5 | 5.00 | — | 0.6 | — | 1.0 | Balance | 1.5 | 1.00 | — | 0.6 | 0.062 | 0.138 | 0.80 | 243 | 32 | |
| 6 | Balance | 1.5 | 5.50 | — | 0.6 | — | 1.0 | Balance | 1.5 | 1.10 | — | 0.6 | 0.062 | 0.138 | 0.80 | — | — | loss of Shape |
| 11 | Balance | 1.5 | 2.50 | 5.00 | 0.6 | — | 1.0 | Balance | 1.5 | 0.50 | 2.00 | 0.6 | 0.062 | 0.138 | 0.80 | 220 | 41 | |
| Effect of Si content | | | | | | | | | | | | | | | | | | |
| 1 | Balance | 1.5 | — | — | 0.6 | — | 1.0 | Balance | 1.5 | — | — | 0.6 | 0.062 | 0.138 | 0.80 | 121 | 80 | Substantial Tool Wear |
| 7 | Balance | 1.5 | — | 2.50 | 0.6 | — | 1.0 | Balance | 1.5 | — | 1.00 | 0.6 | 0.062 | 0.138 | 0.80 | 141 | 68 | Substantial Tool Wear |
| 8 | Balance | 1.5 | — | 5.00 | 0.6 | — | 1.0 | Balance | 1.5 | — | 2.00 | 0.6 | 0.062 | 0.138 | 0.80 | 207 | 36 | |
| 9 | Balance | 1.5 | — | 7.50 | 0.6 | — | 1.0 | Balance | 1.5 | — | 3.00 | 0.6 | 0.062 | 0.138 | 0.80 | 232 | 34 | |
| 10 | Balance | 1.5 | — | 10.00 | 0.6 | — | 1.0 | Balance | 1.5 | — | 4.00 | 0.6 | 0.062 | 0.138 | 0.80 | 259 | 42 | Less Compressible |
| 11 | Balance | 1.5 | 2.50 | 5.00 | 0.6 | — | 1.0 | Balance | 1.5 | 0.50 | 2.00 | 0.6 | 0.062 | 0.138 | 0.80 | 220 | 41 | |
| Effect of Boron Oxide content | | | | | | | | | | | | | | | | | | |
| 12 | Balance | 1.5 | 2.50 | — | 0.6 | — | — | Balance | 1.5 | 0.50 | — | 0.6 | — | — | — | 353 | 85 | Substantial Tool Wear |
| 13 | Balance | 1.5 | 2.50 | — | 0.6 | 0.01 | — | Balance | 1.5 | 0.50 | — | 0.6 | 0.003 | 0.007 | — | 248 | 50 | |
| 14 | Balance | 1.5 | 2.50 | — | 0.6 | 0.20 | — | Balance | 1.5 | 0.50 | — | 0.6 | 0.062 | 0.138 | — | 200 | 35 | |
| 15 | Balance | 1.5 | 2.50 | — | 0.6 | 0.50 | — | Balance | 1.5 | 0.50 | — | 0.6 | 0.155 | 0.345 | — | 206 | 34 | |
| 16 | Balance | 1.5 | 2.50 | — | 0.6 | 1.00 | — | Balance | 1.5 | 0.50 | — | 0.6 | 0.311 | 0.689 | — | 198 | 34 | |
| 17 | Balance | 1.5 | 2.50 | — | 0.6 | 1.10 | — | Balance | 1.5 | 0.50 | — | 0.6 | 0.342 | 0.758 | — | 185 | 35 | Strength Degradation |

② Effect of Si Content

Figure 3:
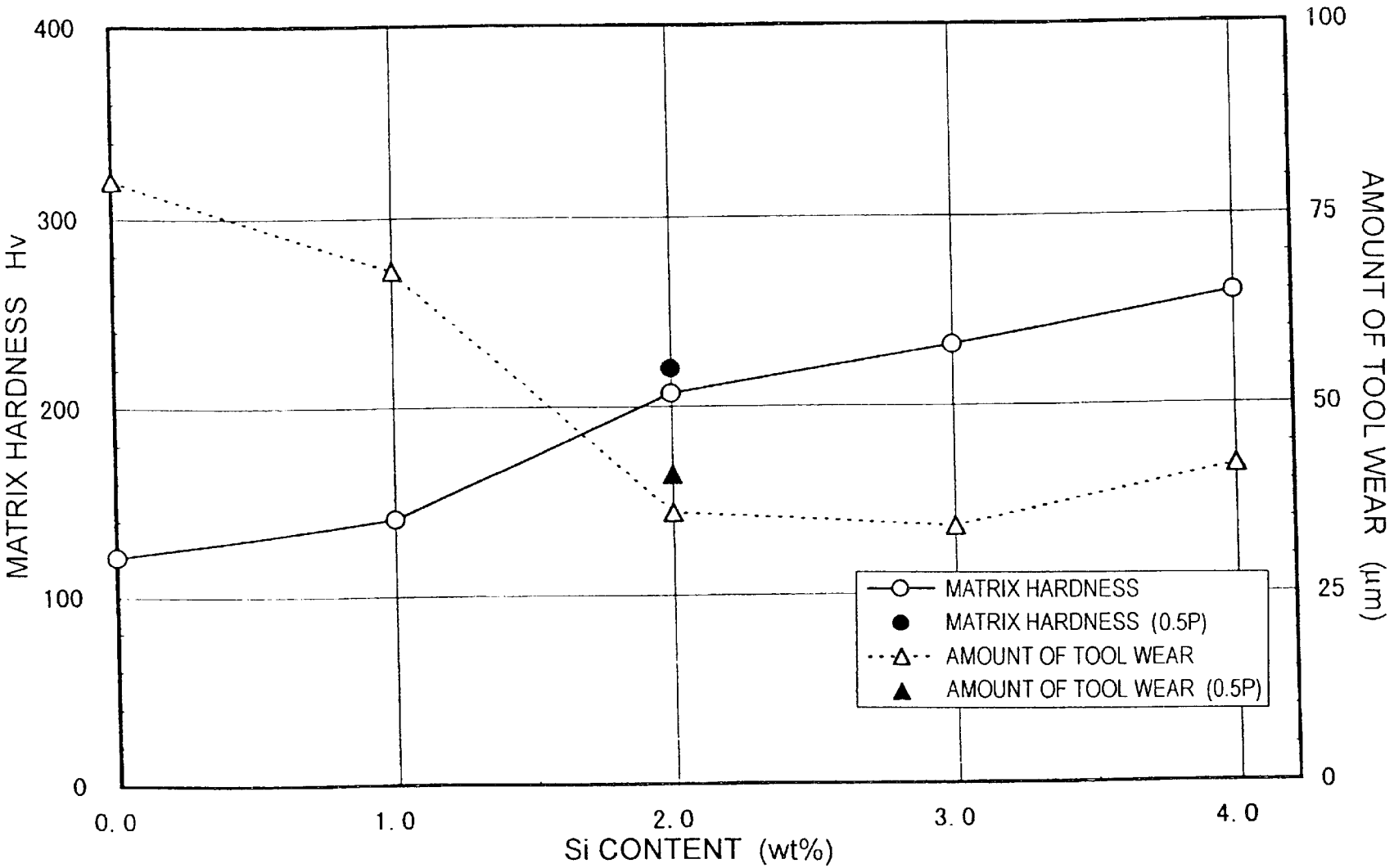
FIG. 3 is a chart showing the relationship between the Si content, the matrix hardness, and the amount of tool wear.

Samples of differing Si content were selected from Table 1 and are described in Table 2. The Si content, matrix hardness, and amount of tool wear described in Table 2 are shown in FIG. 3. As is apparent from FIG. 3, the matrix hardness greatly increases until the Si content increases to 2.0% by weight, and the matrix hardness increases with the increase in the Si content thereafter. In contrast, the amount of tool wear rapidly decreases until the Si content increases to 2.0% by weight. In addition, in sample No. 10 in which the Si content exceeds 3.0% by weight, compressibility of the powder was decreased, whereby strength of the sintered compact was decreased. Therefore, the reason for the numerical limitation according to this invention in which the Si content ranges from 2.0 to 3.0% by weight was confirmed.

③ Effect of Addition Amount of Boron Oxide Powder

Figure 4:
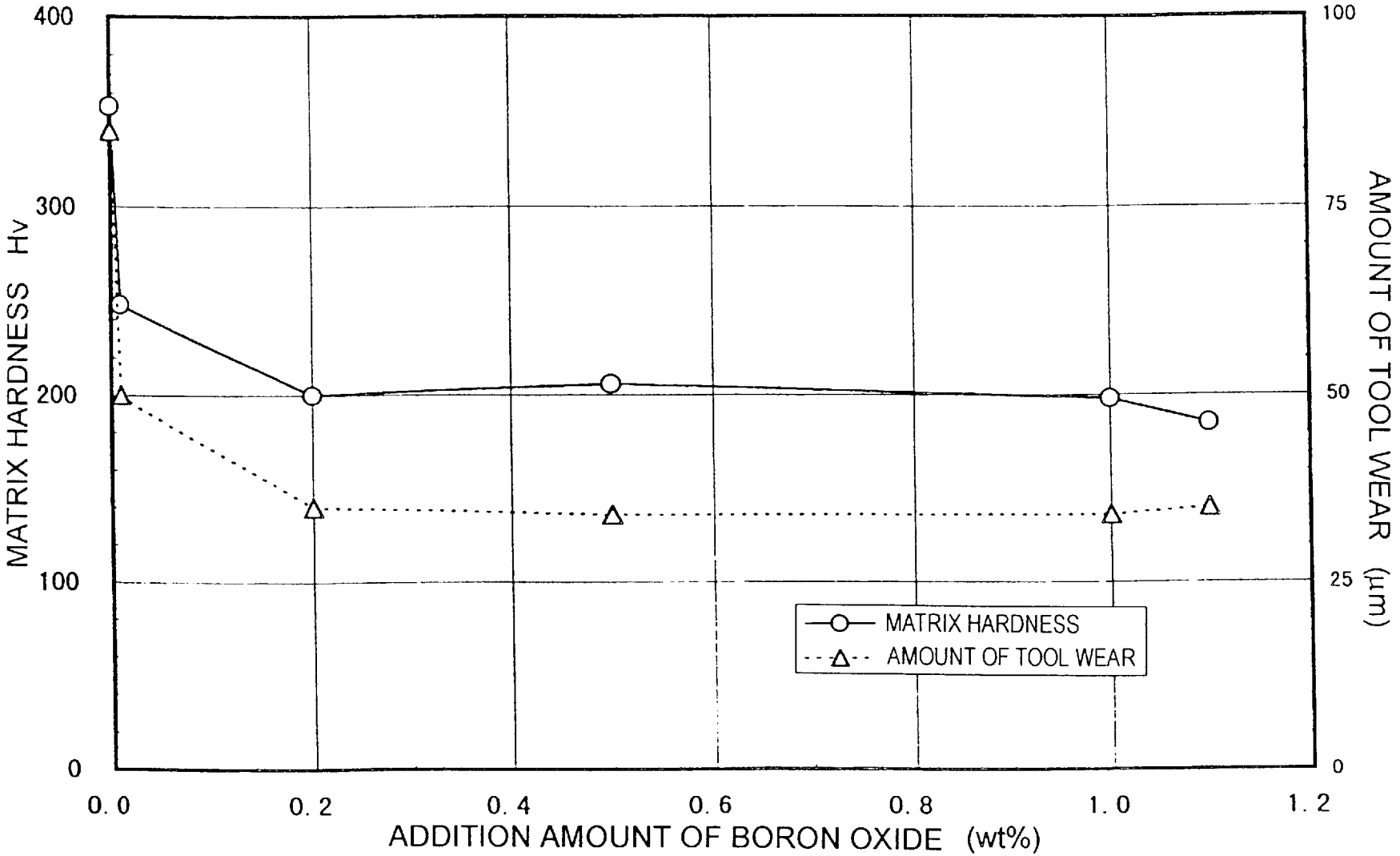
FIG. 4 is a chart showing the relationship between the addition amount of boron oxide powder, the matrix hardness, and the amount of tool wear.

Samples of differing boron oxide powder content were selected from Table 1 and are described in Table 2. Addition amount of boron oxide powder, matrix hardness, and amount of tool wear described in Table 2 are shown in FIG. 4. As is apparent from FIG. 4, the matrix hardness rapidly decreases by adding the boron oxide powder at 0.01% by weight, and the amount of tool wear also rapidly decreases therewith. In contrast, in sample 17 in which the addition amount of boron oxide powder exceeds 1.0% by weight, machinability was good; however, strength degradation of the matrix was confirmed. Therefore, the reason for the numerical limitation according to this invention in which the addition amount of boron oxide powder ranges from 0.01 to 1.0% by weight was confirmed.

④ Effect of Cu Content

Figure 5:
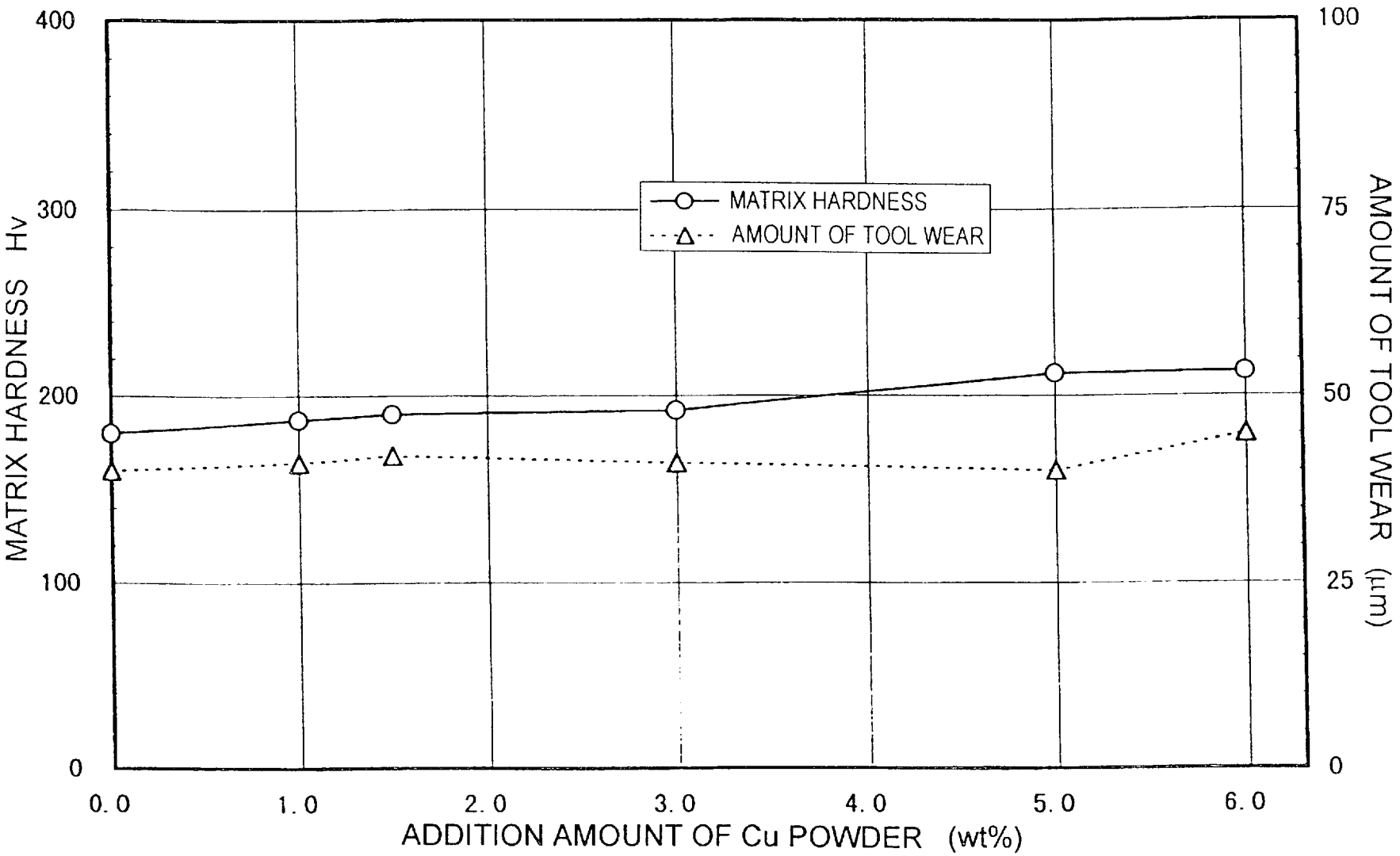
FIG. 5 is a chart showing the relationship between the addition amount of Cu powder, the matrix hardness, and the amount of tool wear.

Samples of differing addition amounts of Cu powder (Cu content) were selected from Table 1 and are described in Table 3. The addition amount of Cu powder, matrix hardness, and amount of tool wear described in Table 3 are shown in FIG. 5. As is apparent from FIG. 5, there was no remarkable change with respect to the matrix hardness and the amount of tool wear by adding the Cu powder. In contrast, the strength of the sintered compact is improved by adding the Cu powder and increases as the addition amount thereof increases. However, dimensional accuracy was lowered by increased generation of the Cu liquid phase and the Cu expansion phenomenon in sample No. 22. Therefore, the effects of this invention could also be confirmed in an Fe—C type alloy (sample No. 18), and in addition, improvement in strength was confirmed for a Cu content ranging from 1.0 to 5.0% by weight without lowering machinability, and the reason for the numerical limitation according to this invention was confirmed.

TABLE 3

| Sample | Mixing Ratio wt % | | | | | | | Overall Constituent Composition wt % | | | | | | | | Evaluated Item | | |
|---|---|---|---|---|---|---|---|---|---|---|---|---|---|---|---|---|---|---|
| | | | | | | | | | | | | | | | | | Tool | |
| | Fe | Cu | Fe-20P | Fe-40P | Graphite | Boron Oxide | Boron Nitride | | | | | | | | | Matrix Hardness | Wear Amount | |
| No. | Powder | Powder | Powder | Powder | Powder | Powder | Powder | Fe | Cu | P | Si | C | B | O | BN | (Hv) | ($\mu$m) | Note |
| Effect of Cu content | | | | | | | | | | | | | | | | | | |
| 18 | Balance | — | 2.50 | — | 0.6 | 0.50 | — | Balance | — | 0.50 | — | 0.6 | 0.155 | 0.345 | — | 180 | 40 | |
| 19 | Balance | 1.0 | 2.50 | — | 0.6 | 0.50 | — | Balance | 1.0 | 0.50 | — | 0.6 | 0.155 | 0.345 | — | 187 | 41 | |
| 15 | Balance | 1.5 | 2.50 | — | 0.6 | 0.50 | — | Balance | 1.5 | 0.50 | — | 0.6 | 0.155 | 0.345 | — | 206 | 34 | |
| 20 | Balance | 3.0 | 2.50 | — | 0.6 | 0.50 | — | Balance | 3.0 | 0.50 | — | 0.6 | 0.155 | 0.345 | — | 192 | 41 | |
| 21 | Balance | 5.0 | 2.50 | — | 0.6 | 0.50 | — | Balance | 5.0 | 0.50 | — | 0.6 | 0.155 | 0.345 | — | 212 | 40 | |
| 22 | Balance | 6.0 | 2.50 | — | 0.6 | 0.50 | — | Balance | 6.0 | 0.50 | — | 0.6 | 0.155 | 0.345 | — | 213 | 45 | less Dimensional Accuracy |
| Effect of Graphite content | | | | | | | | | | | | | | | | | | |
| 23 | Balance | — | 2.50 | — | — | 0.50 | — | Balance | — | 0.50 | — | — | 0.155 | 0.345 | — | 178 | 120 | Substantial Tool Wear |
| 24 | Balance | — | 2.50 | — | 0.1 | 0.50 | — | Balance | — | 0.50 | — | 0.1 | 0.155 | 0.345 | — | 181 | 80 | |
| 18 | Balance | — | 2.50 | — | 0.6 | 0.50 | — | Balance | — | 0.50 | — | 0.6 | 0.155 | 0.345 | — | 180 | 40 | |
| 25 | Balance | — | 2.50 | — | 1.0 | 0.50 | — | Balance | — | 0.50 | — | 1.0 | 0.155 | 0.345 | — | 192 | 40 | |
| 26 | Balance | — | 2.50 | — | 1.5 | 0.50 | — | Balance | — | 0.50 | — | 1.5 | 0.155 | 0.345 | — | 220 | 41 | |
| 27 | Balance | — | 2.50 | — | 2.0 | 0.50 | — | Balance | — | 0.50 | — | 2.0 | 0.155 | 0.345 | — | 249 | 49 | |
| 28 | Balance | — | 2.50 | — | 2.2 | 0.50 | — | Balance | — | 0.50 | — | 2.2 | 0.155 | 0.345 | — | 260 | 82 | Substantial Tool Wear |

⑤ Effect of C Content

Figure 6:
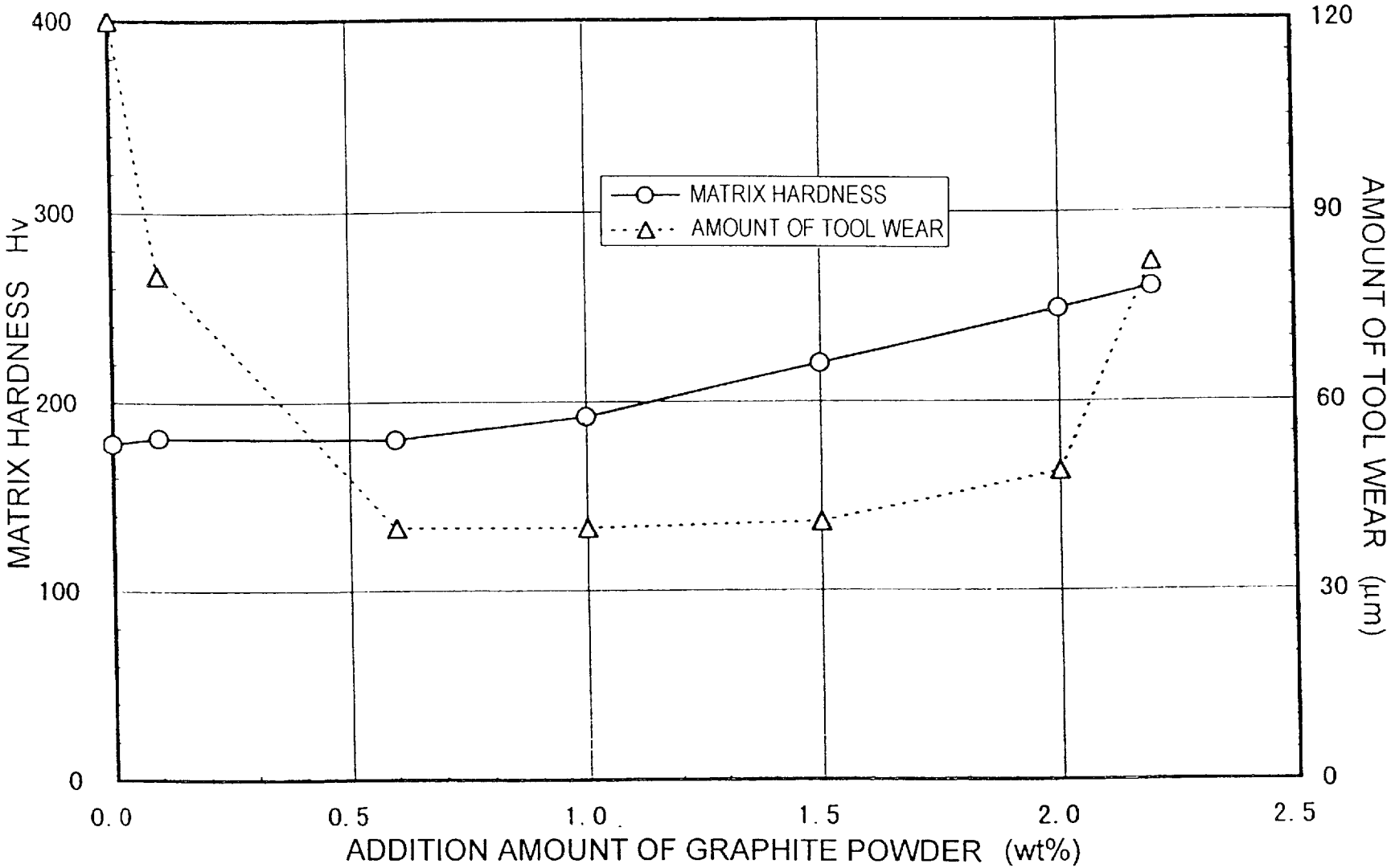
FIG. 6 is a chart showing the relationship between the addition amount of graphite powder, the matrix hardness, and the amount of tool wear.

Samples of differing addition amounts of graphite powder (C content) were selected from Table 1 and are described in Table 3. The addition amount of graphite powder, matrix hardness, and amount of tool wear described in Table 3 are shown in FIG. 6. As is apparent from FIG. 6, in the case in which the addition amount of graphite powder is 0.1% by weight, the amount of tool wear rapidly decreases. However, pearite was formed in sample No. 28 in which the addition amount of graphite powder exceeded 2.0% by weight, whereby the amount of tool wear increased. Therefore, the reason for the numerical limitation according to this invention in which the C content ranges from 0.1 to 2.0% by weight was confirmed.

As explained above, according to the present invention, boron is contained in an Fe-based sintered alloy, and the matrix hardness is made to be Hv 150 to 250, whereby diffusion of C from graphite is prevented and free graphite remained, so that machinability can be rapidly improved while maintaining a degree of hardness.

What is claimed is:

1. A good machinability Fe-based sintered alloy comprising, in percent by total weight:

at least one element selected from the group consisting of P in an amount of 0.1 to 1.0% and Si in an amount of 2.0 to 3.0%;

B in an amount of 0.003 to 0.31%;

O in an amount of 0.007 to 0.69%;

C in an amount of 0.1 to 2.0%; and balance consisting of Fe and unavoidable impurities, wherein the matrix hardness ranges from Hv 150 to 250, and free graphite is dispersed therein.

2. A good machinability Fe-based sintered alloy as recited in claim 1, further comprising Cu in an amount of 1.0 to 5.0% by weight.

3. A good machinability Fe-based sintered alloy as recited in claim 1, wherein BN in an amount of 0.06 to 2.25% by weight is further dispersed in said matrix.

4. A good machinability Fe-based sintered alloy as recited in claim 2, wherein BN in an amount of 0.06 to 2.25% by weight is further dispersed in said matrix.

5. A process of manufacturing a blend suitable for sintering into a machinable Fe-based alloy comprising:

adding a mixed powder comprising, in percent by weight of the total weight of said mixed powder:

a n Fe-based powder comprising at least one element selected from the group consisting of P in an amount of 0.1 to 1.0% and Si in an amount of 2.0 to 3.0%; and the balance consisting of Fe an unavoidable impurities, a graphite powder in an amount of 0.1 to 2.0%, and a boron oxide powder in an amount of 0.01 to 1.0%.

6. A process as recited in claim 5 further comprising an addition of a Cu powder in an amount of 1.0 to 5.0% by weight into said mixed powder.

7. A process as recited in claim 5 further comprising an addition of a boron nitride powder, containing boron oxide in an amount of 10 to 40% by weight, in an amount of 0.1to 2.5% by weight, and omission of said boron oxide powder.

* * * * *